United States Patent [19]

Mizoguchi

[11] 4,386,631

[45] Jun. 7, 1983

[54] NEGATIVE DOUBLE LIFT DOBBY MACHINE

[75] Inventor: Hiroyuki Mizoguchi, Aichi, Japan

[73] Assignee: Yamada Dobby Co., Ltd., Aichi, Japan

[21] Appl. No.: 232,421

[22] Filed: Feb. 9, 1981

[30] Foreign Application Priority Data

Feb. 7, 1980 [JP] Japan ..... 55-13971

[51] Int. Cl.[3] ..... D03C 1/06

[52] U.S. Cl. ..... 139/68; 139/71

[58] Field of Search ..... 139/68, 71, 74, 331

[56] References Cited

U.S. PATENT DOCUMENTS

| | | | |
|---|---|---|---|
| 3,285,291 | 11/1966 | Favre | 139/68 |
| 4,182,380 | 1/1980 | Palau | 139/68 |
| 4,305,432 | 12/1981 | Schwarz | 139/71 X |

FOREIGN PATENT DOCUMENTS

| | | | |
|---|---|---|---|
| 2440374 | 5/1976 | Fed. Rep. of Germany | 139/71 |
| 2428693 | 1/1980 | France | 139/68 |
| 651848 | 4/1951 | United Kingdom | 139/331 |

*Primary Examiner*—James Kee Chi

*Attorney, Agent, or Firm*—Armstrong, Nikaido, Marmelstein & Kubovcik

[57] ABSTRACT

In a negative double lift dobby machine, a balance lever 8 is pivotally attached to a jack-lever, and driving members 16, 17 disposed respectively in front of upper and lower ends of the balance lever 8 reciprocate in opposite phases with each other. Driven hook levers 10, 11 are pivotally attached to the upper and lower ends of the balance lever 8, and driving hook levers 18, 19 opposite to the driven hook levers 10, 11 are pivotally attached to the driving members 16, 17. Command levers rotate the driving hook levers 18, 19 to be engaged with the driven levers 10, 11 respectively. Flat surfaces 10*b*, 11*b* constituted in the driven hook levers 10, 11 respectively push stoppers 12, 13 under surface contact state. When the driven hook levers 10, 11 begin to be pulled by the driving hook levers 18, 19 respectively, the driven hook levers 10, 11 are moved in perpendicular direction to the flat surfaces 10*b*, 11*b*, engaging portion of the driven hook lever 10 with the driving hook levers 18 is on the ine connecting between pivotal centers of both hook levers 10 and 18, engaging portion of the driven hook levers 11 with the driving hook levers 19 is on the line connecting between pivotal centers of both hook levers 11 and 19, and rocking center of the pivotal portion of the jack lever 5 with the balance lever 8 is disposed above or below the rotation axial center of the jack-lever 5 on the vertical line passing through the axial center.

6 Claims, 6 Drawing Figures

NEGATIVE DOUBLE LIFT DOBBY MACHINE

BACKGROUND OF THE INVENTION

1. Field of the Invention

The present invention relates to negative double lift dobby machines, and more particularly to double-lift machines wherein a heald frame is biased downwards by spring action, a rope suspending the heald frame is connected to a jack-lever, the center of a balance lever is pivotally attached to the jack-lever, the balance lever is provided with driving members corresponding to both ends of the balance lever, and both driving members reciprocate at opposite phases with each other so as to rock the balance lever through hook means and drive the jack-lever.

2. Description of the Prior Art

Examples of dobby machines in prior art are illustrated in FIGS. 4 and 5.

In FIG. 4, when a heald frame 102 is in the downward position, a rope 103 is supplied with tension corresponding to sum of tension of a spring 101 and weight of the heald frame 102, subtracted by upward combined force based on warp tension; when the heald frame 102 is in the upward position, the rope 103 is supplied with tension corresponding to sum of tension of the spring 101 increased because of the elongation during heald frame elevation, weight of the heald frame 102 and downward combined force based on warp tension. This tension in the rope 103 acts on a connecting portion 105 to a jack-lever 104 which is pivotally connected at a top end 106 to the center of a balance lever 107. When the heald frame 102 is in the downward position, upper and lower ends of the balance lever 107 push stoppers 110 and 111 fixed to the casing through arc-shaped contact pieces 108 and 109 attached to both ends, respectively.

On the contrary, when the heald frame 102 is in the upward position, as shown in dash-and-dot line of FIG. 4, at forward movement of an upper knife 112, for example, the contact piece 109 attached to the lower end of the balance lever 107 pushes the stopper 111 and a hook lever 114 pivotally attached to the upper end of the balance lever 107 is engaged to the upper knife 112 and opposes the tension in the rope 103. In this case, it is evident that both contact pressure of the contact piece with the stopper and reaction force at the engaging portion of the hook lever with the knife in the upward state of the heald frame 102 are greater than those in the downward state thereof.

However, problem of slip and contact variation in pushing contact portions during upward and downward motion of the heald frame 102 is rather serious than amount of the reaction force therein. The contact pieces 108 and 109 are arc-shaped, but the balance lever 107 is pivotally attached to the jack-lever 104 which rocks. During rocking motion of the balance lever 107 involved in the motion of the jack-lever 104, the contact pieces 108 and 109 push the stopper 110 and 111 not at simple rolling contact but at sliding state. Moreover, since the contact is effected at line contact, the load per unit area becomes larger, resulting in abrasion at contact portions.

The knives 112 and 113 are heald substantially in the horizontal direction, but they are pivotally attached to upper and lower ends of a rocking lever 116 supported at the center. Accordingly, motion of the knives 112, 113 and that of pivotal portion of the hook lever 114, 115 follow respective circular arcs different in radius lenght. Therefore variation of contact state occurs at engaging portions between hooks of the hook levers 114, 115 and the knives 112, 113. This also causes abrasion in contact portions.

As above described, the dobby machine of this type has a disadvantage that abrasion of working parts causes rapid reduction of function.

In the dobby machine of this type, control rods 117 and 118 controlling the hook levers 114 and 115 or the like are interposed between the knives and the balance lever. In order to obviate interfere between parts, therefore, distance between the knives and the balance lever is taken large thereby the hook lever become longer than required for working. This obstructs the high-speed operation and requires the larger installation area.

FIG. 5 shows another example of prior art. In this figure, the spring 101, the heald frame 102, the rope 103, the jack lever 104 or the like are constituted similarly to FIG. 4. The center of a balance lever 120 is pivotally attached at 119 to the jack lever 104, and hook levers 121 and 122 are pivotally attached to both ends of the balance lever 120. A rocking lever 123 is provided with rocking shaft concentric to the balance lever pivotal shaft 119. Driving members 124 and 125 fixed to both ends of the rocking lever 123 are opposite to base portions of the hook levers 121 and 122, respectively. The driving members 124 and 125 push base portions of the hook lever 121 and 122, when the heald frame 102 is in the downward position. Stopping hook levers 126 and 127 are pivotally attached to shafts fixed on the casing. Command arms 128 and 129 are pivotally mounted in concentric relation and connected with each other through a spring. The command arms 128 and 129 work responding to pegs on a peg card. For example, the rocking lever 123 is rotated counterclockwise and the hook lever 122 is engaged with the stopping hook lever 127. If the rocking lever 123 is rotated clockwise in this state, the balance lever 120 is rotated clockwise about the pivotal shaft to the hook lever 122 and the jack-lever 104 is also rotated clockwise thereby the heald frame 102 rises.

As the dobby machine is constituted as above described, when the hook lever 121, 122 are not engaged with the stopping hook levers 126, 127 and the heald frame is in the downward position the balance lever 120 rocks integral with the rocking lever 123 about the pivotal portion 119 to the jack-lever 104. In this state, tension of the rope 103 produces reaction force to the pivotal portion 119 through connecting portion. If one of a plurality of heald frames 102 is not used corresponding to textile pattern, the jack-lever 104 and the balance lever 120 corresponding to the unused heald frame 102 are rocked under the load at the pivotal portion. Accordingly, abrasion may occur in these jack lever 104 and balance lever 120 in similar grade to those corresponding to the used heald frame 102.

Accordingly, both examples of conventional negative dobby machines using a balance lever have disadvantages.

SUMMARY OF THE INVENTION

An object of this invention is to provide a dobby machine wherein rapid abrasion of fulcrum member is obviated during rocking motion of a balance lever.

Another object of this invention is to provide a dobby machine wherein rapid abrasion is obviated in members used for hooks installed for transmission of motion between driving member and the balance lever.

Still another object of this invention is to provide a dobby machine wherein abrasion of the jack-lever and the balance lever corresponding to unsued heald frame is obviated.

Further object of this invention is to provide a dobby machine wherein reduction of length of the hook lever permits the high-speed operation and decrease of the installation space.

DESCRIPTION OF THE PREFERRED EMBODIMENT

Subject-matter of a dobby machine according to the present invention is in that a balance lever is provided with two driving members corresponding to both ends of the balance lever and the driving members reciprocate in opposite phases with each other, driving hook levers are rotatably fitted to the driving members corresponding to the balance lever, driven hook levers constituted engageable with the driving hook levers are pivotally attached to both ends of the balance lever, reaction force produced at both ends of the balance lever against stoppers by the rope tension at the downward state of the heald frame is received at flat surfaces installed at the driven hook levers and for plane contact with stoppers, the driven hook levers are arranged in prescribed attitude at pushing state of the flat surfaces with stoppers, command for the upward and downward motion of the heald frame is transmitted by angular displacement of the driving hook levers rotatably fitted to the two driving members reciprocating in opposite phases and by engaging or releasing the driving hook levers with corresponding driven hook levers, command levers in bell crank shape for processing the command are pivotally attached to shafts fixed to the casing, the end of lever contacting to the driving hook levers have elasticity, and other side of lever is rotated by pegs on a peg card or by horizontal lever for paper card.

Figure 1:
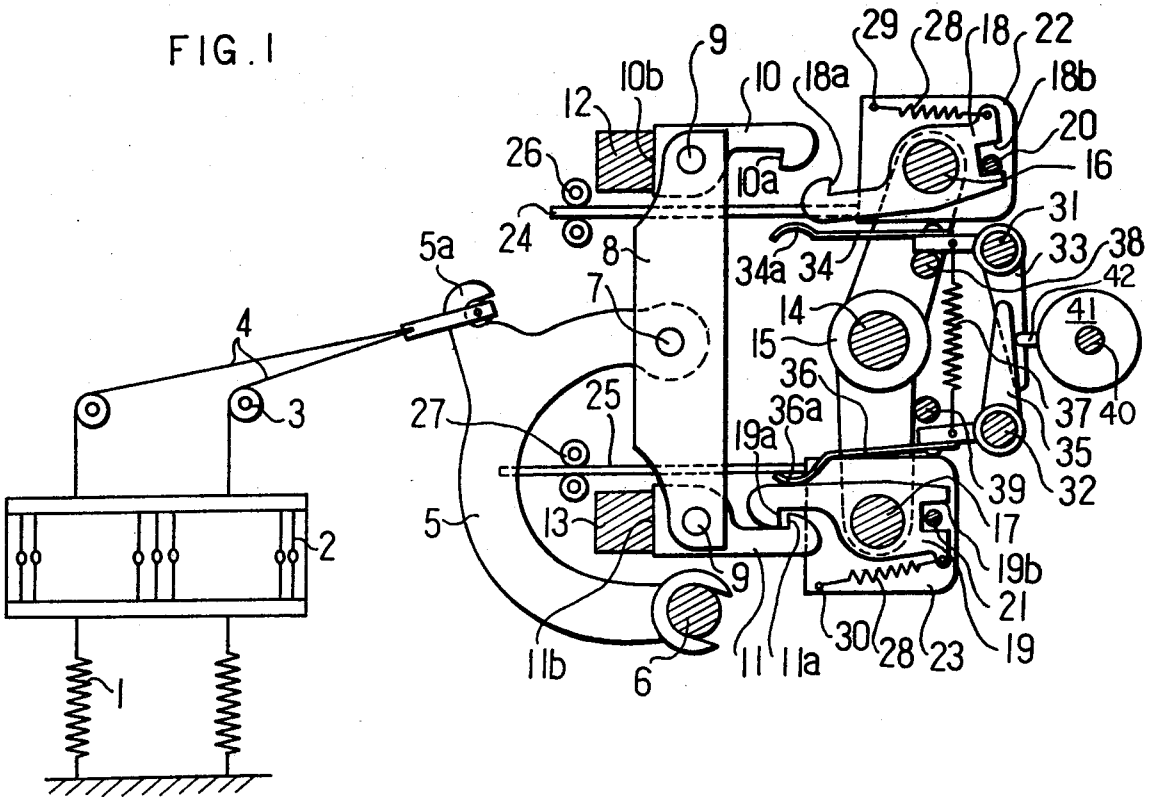
FIG. 1 is a view illustrating an embodiment of the present invention.

Constitution of the present invention is now to be described in an embodiment shown in accompanying drawings. Referring to FIG. 1, a dobby machine comprises a tension coil spring 1, a heald frame 2, guide rollers 3, ropes 4, and a jack lever 5, each member being as in conventional negative dobby machines. The lower end of the spring 1 is connected to a casing (not shown) of a loom, the guide rollers 3 are fitted to shafts fixed on the casing, the base portion of the jack lever 5 is rotatably fitted to a shaft 6 fixed on the casing (not shown) of the dobby machine, and the rope 4 is engaged to a hook 5*a*. A balance lever 8 is connected to the top end of the jack lever 5 through a pin 7. The balance lever 8 is constituted in vertical symmetry with respect to the pin 7. An upper driven hook lever 10 is pivotally connected to the top end of the balance lever 8 through a pin 9. The hook lever 10 is provided with a hook 10*a* at the right and and a flat surface 10*b* at the left. Extension of the line connecting the center of the hook 10*a* with the axial center of the pin 9 is prependicular to the flat surface 10*b* at the center thereof. A lower driven hook lever 11 in vertical symmmetry to the upper driven hook lever 10 is pivotally connected to the lower end of the balance lever 8 through a pin 9.

An upper stopper 12 and a lower stopper 13 are fixed to the casing so that the balance lever 8 is held in the vertical direction when the heald frame 2 is at the downward position. The right side of the stoppers 12 and 13 is in the same vertical plane to which the flat surfaces 10*b* and 11*b* are contacted. In each of the driven hook levers 10 and 11, the line connecting the center of the hook with the axial center of the pin 9 is in the horizontal direction when the heald frame 2 is held at the downward position.

A shaft 14 is attached to the casing at the right side in the same lever as the pin 7 at the downward state of the heald frame 2. The shaft 14 reciprocates one time in a prescribed angular motion during 2 revolutions of the loom. A lever 15 is fixed to the shaft 14 and extends in upward and downward directions spaced by a prescribed angle. An upper driving member 16 and a lower driving member 17 are fixed respectively to the upper and lower ends of the shaft 14. The driving members 16 and 17 have circular cross-section of the same diameter, and distance from the axial center of the driving member 16 to the shaft 14 and that from the member 17 to the shaft 14 have the same length equal to a half of the distance between pins 9, 9 in the balance lever 8. The axial center of the lower driving member 17 is below the axial center of the shaft 14 in the common vertical plane, when the shaft 14 is rotated clockwise; the axial center of the upper driving member 16 is above the axial center of the shaft 14 in the common vertical plane, when the shaft 14 is rotated counterclockwise.

A lower driving hook lever 19 is fitted to the lower driving member 17 so that it may be rotated about the driving member 17 and engaged with the lower driving hook lever 11. The lower driving hook lever 19 is provided with a hook 19*a* at the left and a cutaway portion 19*b* at the right. When the shaft 14 is rotated clockwise and the hook lever 19 is rotated counterclockwise against a coil spring 28, the hook 19*a* is opposite to the hook 11*a* of the lower driven hook lever 11 pushing the lower stopper 13, a prescribed gap being constituted between the hooks 19*a* and 11*b*, so that the axial center of the lower pin 9, center portion of the hook 19*a*, center portion of the hook 11*a* and the axial center of the lower driving member 17 are arranged in a line. An upper driving hook lever 18 is symmetrical to the lower driving hook lever 19 in the vertical direction. A cutaway portion 18*b* of the hook lever 18 is opposite to an upper stopper bar 20 which extends horizontally (in the perpendicular direction to the paper surface of the drawing). The stopper bar 20 is so constituted that a hook 18*a* of the hook lever 18 rocks approximately along the horizontal line. When the lever 18 is urged counterclockwise and the lower side of the cutaway portion 18*b* is pushed to the stopper bar 20 by a tension coil spring 28 connected to the right end of the hook lever 18, a prescribed vertical gap is constituted between the hook 18*a* and the hook 10*a* and the hook lever 18 may be rocked laterally. A lower stopper bar 21 is symmetrical to the upper stopper bar 20 in the vertical direction. The lower stopper bar 21 is opposite to the upper side of the cutaway portion 19*b* of the lower driving hook lever 19. The stopper bar 21 defines attitude of the driving hook lever 19 so that a prescribed gap is constituted between the hook 19*a* and the hook 11*a* and the hook lever 19 may be rocked.

Blocks 22, 23, to which the stopper bar 20, 21, are fixed, are rotatably fitted to the upper driving member 16 and the lower driving member 17 respectively. One end of a guide rod 24 is fixed to the block 22, and the other end thereof extends leftwards and guided by a pair of guide rollers 26 supported to the casing. A guide rod 25 symmetrical to the block 22 in the vertical direction is fixed to the block 23, and the top end of the guide rod 25 is guided by a pair of guide rollers 27. Other ends of the upper and lower tension coil springs 28 are connected to bars 29, 30 fixed to the blocks 22, 23 respectively.

Fixing shafts 31, 32 are fixed to the casing symmetrically in the vertical direction at the right of the shaft 14. An upper command lever 33 is opposite to the upper driving hook lever 18 and loosely connected to the fixing shaft 31. The command lever 33 is in inverse L-shape, and horizontal portion of the lever 33 is extended by a leaf spring arm 34 and the top end of the arm 34 is bent to form a pushing portion 34*a* of arc shape. The pushing portion 34*a* is disposed below the hook 10*a* of the upper driven hook lever 10 approximately in the vertical direction when the hook lever 10 pushes the stopper 12. Vertical portion of the command lever 33 extends downward and is opposite to a peg as hereinafter described. A lower command lever 35 and a leaf spring arm 36 are symmetrical respectively to the upper command lever 33 and the leaf spring arm 34 in the vertical direction. The command levers 33 and 35 are biased by a tension coil spring 37 which connects horizontal portion of the levers 33 and 35 with each other. The command levers 33 and 35 respectively push stopper shafts 38 and 39 disposed symmetrical to the casing in the vertical direction, so that the pushing portions 34*a* and 36*a* are spaced by a prescribed gap respectively from the driving hook lever 18 and 19 being rocked.

A card cylinder shaft 40 is supported to the casing at the same level as the shaft 14 and rotated in association with the rocking motion of the shaft 14. A card cylinder 41 is fixed to the card cylinder shaft 40, and a known endless peg card is circulated by rotating the card cylinder 41. The peg card is provided with a peg 42 extending upwards from the card surface. When the rotation of the card cylinder shaft 40 makes the top end of the peg 42 push the vertical portion of the command lever 33 into clockwise rotation, the pushing portion 34*a* moves upwards so as to rotate the upper driving hook lever 18 clockwise with elasticity. When the driving hook lever 18 is moved leftwards, the hook 18*a* is opposite to the hook 10*a* of the upper driven hook lever 10 pushing the stopper 12. The lower command lever 35 is also pushed by the peg 42 so as to rotate the lower driving hook lever 19 in similar manner to the upper driving hook lever 18.

Figure 2:
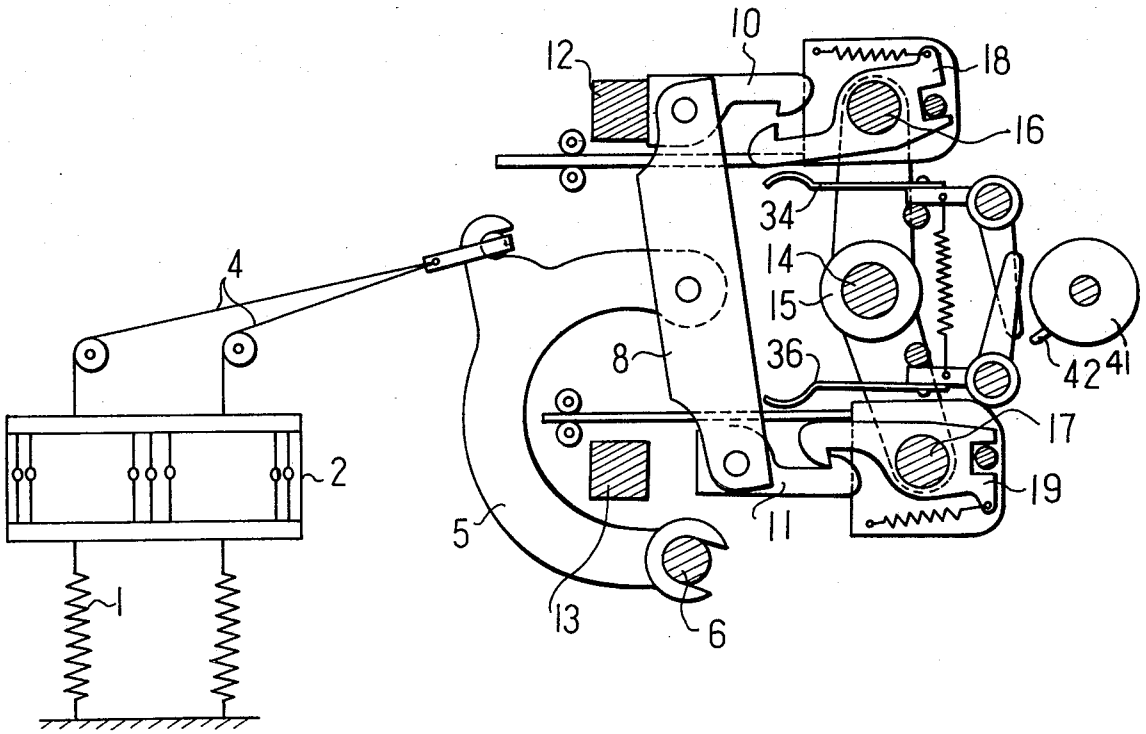
FIG. 2 is a view illustrating the upward state of heald frame of the dobby machine shown in FIG. 1.

Since a negative double lift dobby machine is constituted as above described, when the peg card is circulated and the peg 42 pushes the lower command lever 35 as shown in FIG. 1, the command lever 35 is rotated counterclockwise against the spring 37 and depresses the lower driving hook lever 19 rocking leftwards. when the lower driving hook lever 19 approaches the lower driven hook lever 11 and then touches it, the driving hook lever 19 is guided by sliding curved surfaces of hooks of both levers and rotated clockwise against the leaf spring arm 36. When the driving hook lever 19 moves further and the hook 19*a* passes the hook 11*a*, the driving hook lever 19 is restored by the pushing force of the leaf spring arm 36 so that the hook 19*a* is opposite to the hook 11*a*. If the lower driving hook lever 19 rocks rightwars in this state, the driving hook lever 19 and the driven hook lever 11 are engaged with each other, the balance lever 8 is rotated counter clockwise about the upper pin 9 as fulcrum, the jack lever 5 is rotated clockwise, and the heald frame 2 begins to rise. When the lower driving hook lever 19 finishes the rightward movement, the heald ends the upward movement (Refer to FIG. 2). In the above mentioned process, when the flat surface 11*b* of the lower driven hook lever 11 is being separated from the lower stopper 13, the axial center of the pin 9, center portion of the hook 11*a*, center portion of the hook 19*a* and the axial center of the lower driving member 17 are arranged in a strait line, and the connecting line between centers of the shaft 14 and the member 17 and also the flat surface 11*b* are in the perpendicular direction with respect to the above mentioned strait line, thereby the right side surface of the stopper 13 can be separated from the flat surface 11*b* at a time. Since the pin 9, the hook 11*a* the hook 19*a* and the driving member 17 are aligned even during movement by means of resistance, the engaging state between the hooks 11*a* and 19*a* does not vary and the sliding action does not occur. The balance lever 8 is rotated about the pin 9 therefore does not slide at narrow area. Sliding action occurs between the right side surface of the upper stopper 12 and the flat surface 10*b* corresponding to vertical displacement amount accompanying the circular motion of the pin 7, however, the amount is little. Furthermore, the load per unit area is little because of the contact of flat surface. In this case, the pin 7 is rocked preferably between symmetric positions with respect to the vertical line passing through the axial center of the shaft 6, in order to decrease the sliding amount between the stoppers 12, 13 and the flat surfaces 10*b*, 11*b*. When the lower driving hook lever 19 rocks leftwards, the contacting state between the hooks 11*a* and 19*a* does not vary and the balance lever 8 is restored by rotation about the upper pin 9 as fulcrum in similar manner to the case of the rightward rocking. When the upper command lever 33 is rotated clockwise by the peg 42, the upper driving hook lever 18 works like the lower driving hook lever 19 and elevates the heald frame 2 through the upper driven hook lever 10, the balance lever 8 and the jack lever 5.

Since the peg 42 is not arranged to the position oposite to the command lever corresponding to unused one of the heald frame 2, the upper driving hook lever 18 and the lower driving hook lever 19 are not rotated. Therefore the balance lever 8 is held in the vertical direction by the stoppers 12, 13 through flat surface of the driven hook levers 10, 11, thereby the heald frame is held at the downward position. Accordingly, rotating mototion does not occur at the pivotal portion, between the balance lever 8 and the jack-lever 5. Since the stopper bars 20, 21 and bars 29, 30 are fixed on the blocks 22, 23 moved approximately in parallel motion, the horizontal and vertical position with respect to the driving member 16, 17 is held approximately constant irrespective of position of the rocking arms. Thereby the driving hook levers 18, 19 are rocked in parallel movement when the cutaway portions 18*b*, 19*b* push the stoppers 20, 21 respectively.

Figure 3A:
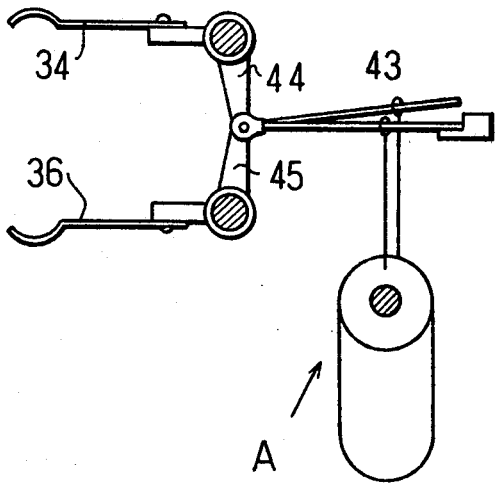
FIGS. 3A–3B illustrate another embodiment of means operating a command lever.

FIG. 3A shows another embodiment of a device to operate command levers. This device operates command levers using a paper card rather than a peg card as in the previous embodiment.

The device to operate the command levers 44, 45 is constituted as follows:

The command levers 44, 45 have leaf spring arms 34, 35 fixed at one end, and horizontal levers 43 of a known paper card device A are pivotally attached to the other end of the command levers 44, 45 respectively. When the paper card hole comes to a prescribed position, the horizontal levers 43 are moved forwards (to the left in FIG. 3A) and thereby the command levers 44, 45 are rotated.

If the command lever 44 or 45 is rotated by the movement of the corresponding horizontal lever 43, the leaf spring arm 34 or 36 raises or depresses the driving hook lever 18 or 19.

Figure 3B:
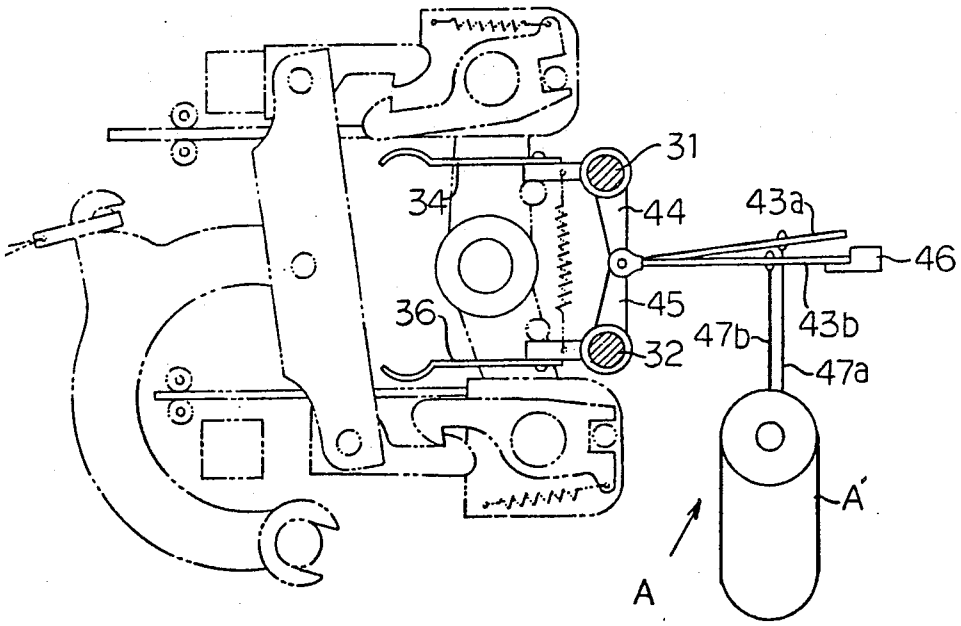
Figure 4:
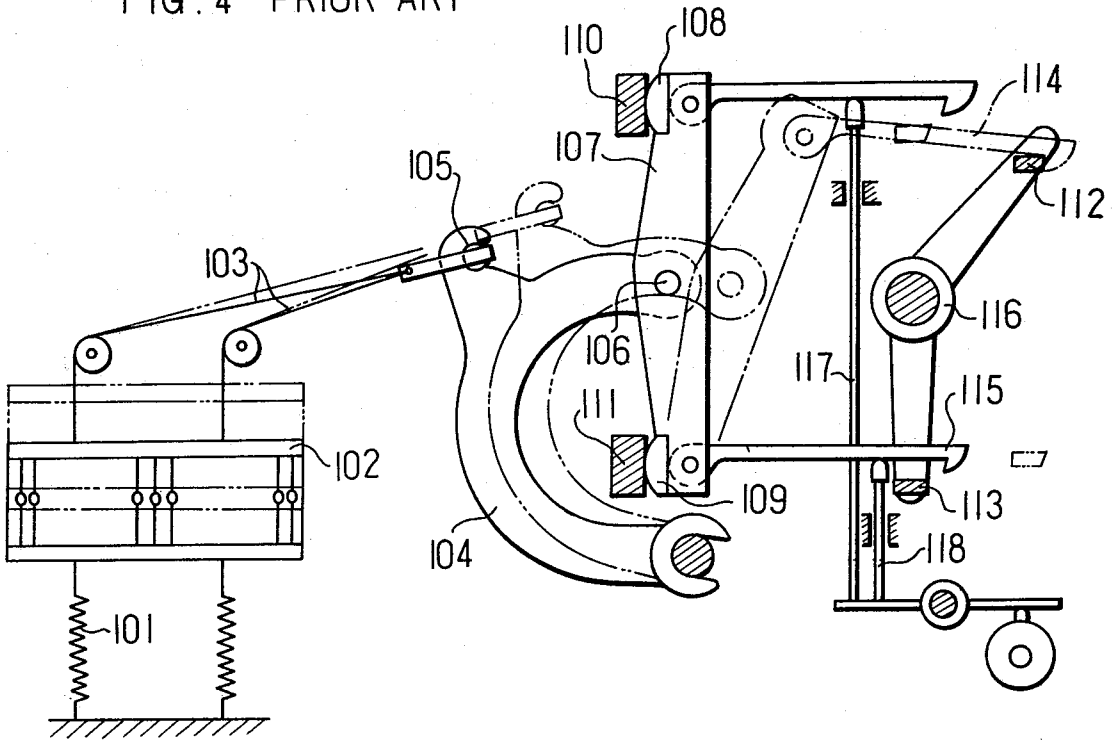
FIG. 4 PRIOR ART
FIG. 4 is a view illustrating an example of prior art.
Figure 5:
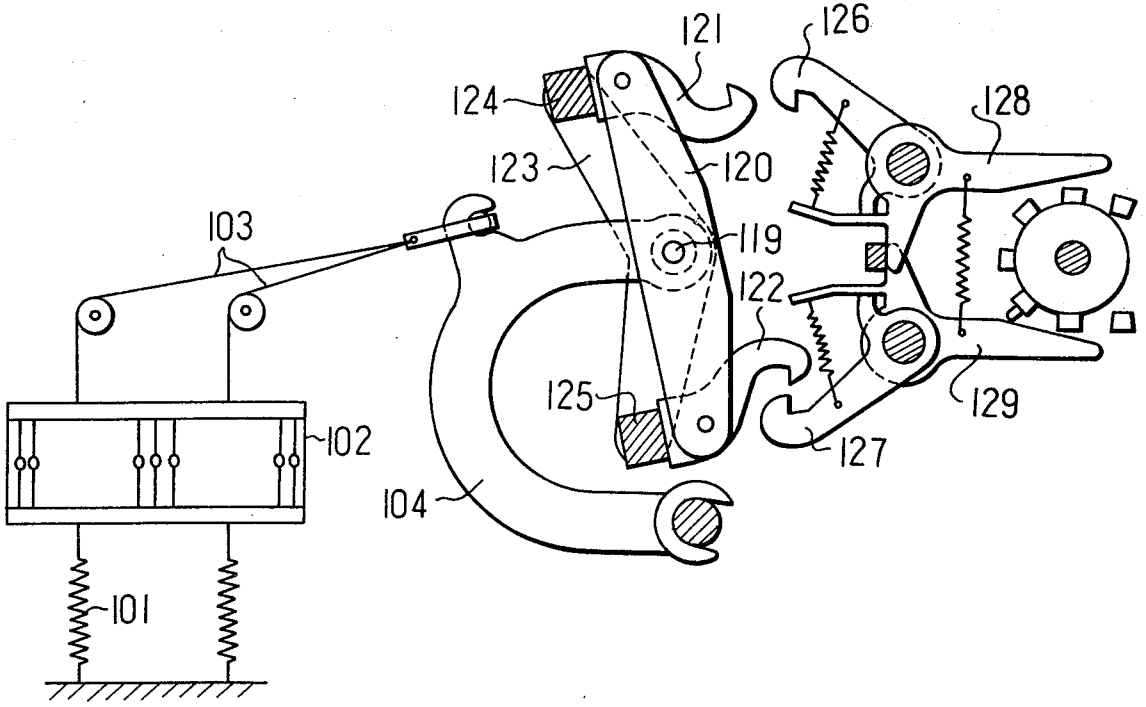
FIG. 5 PRIOR ART
FIG. 5 is a view illustrating another example of prior art.

The device to operate the command levers will be described in detail referring to FIG. 3B.

The horizontal levers 43*a*, 43*b* are pivotally attached to the other end of the command levers 44, 45 respectively, and vertical levers 47*a*, 47*b* are connected to the horizontal levers 43*a*, 43*b* respectively. Paper card A′ is disposed below the horizontal levers 47*a*, 47*b* and held on the paper card device A and rotated. If a hole perforated on the paper card A′ comes to the position below the vertical lever 47*a* or 47*b*, the vertical lever 47*a* or 47*b* falls thereby the horizontal lever 43*a* or 43*b* is moved downwards. The horizonal knife 46 is installed near the top end of the horizontal levers 43*a*, 43*b* and moved horizontally and periodically in reciprocating linear motion.

If the horizontal lever 43*a* or 43*b* is moved downwards and entered into the movement trace of the horizontal knife 46, the horizontal lever 43*a* or 43*b* is moved forwards (to the left in the figure).

Since the vertical lever 47*a* or 47*b* falls and the horizontal lever 43*a* or 43*b* is moved downwards, if a hole on the paper card A′ comes to the position below the vertical lever 47*a* or 47*b*, the horizontal lever 43*a* or 43*b* is moved forwards by the horizontal knife 46 and thereby the command lever 44 or 45 is rotated.

The present invention is not restricted by the above description and accompanying drawings, modification of embodiment may be performed within a scope of technical idea of the invention.

What is claimed is:

1. A negative double lift dobby machine comprising:

(a) a casing;

(b) a jack-lever;

(c) a balance lever pivotally attached to said jack-lever;

(d) driving members positioned in front of both the upper and lower ends of said balance lever and reciprocating in opposite phases with each other;

(e) driving hook levers pivotally attached to corresponding driving members in opposition to said balance lever, each driving hook lever having a hook on one end thereof, said driving hook levers moving in response to the reciprocating movement of the corresponding driving member;

(f) driven hook levers, which are engageable with said driving hook levers, pivotally attached to the upper and lower ends of said balance lever, each said driven hook levers having a hook on one end thereof and a flat surface on the opposite end thereof; and (g) stopper means for contacting said flat surface in a plane, said stopper means being fixed to said casing.

2. A negative double lift dobby machine according to claim 1, wherein stopper means are positioned on a common vertical line and said driving hook levers engage respectively with said driven hook levers, the line between pivotal centers of said driving hook lever and said driven hook lever and the line between pivotal centers of said driving hook and said driven hook lever are perpendicular to the line between pivotal centers of said driven hook levers at the start of pulling and wherein said line between pivotal centers of corresponding said driving hook levers and said driven hook levers passes through said corresponding hooks thereof.

3. A negative double lift dobby machine according to claim 2, wherein the rocking center of a pivotal portion of said jack-lever and said balance is disposed above or below a pivotal axial center of said jack-lever on the common vertical line with said pivotal axial center.

4. A negative double lift dobby machine according to claim 1, wherein command levers are pivotally attached to fixing shafts and extend to the same sides as said driving hook lever with respect to said driving members, said command levers including means for rotating said driving hook levers.

5. A negative double lift dobby machine according to claim 4, wherein said command levers including a resilient elastic body.

6. A negative double lift dobby machine according to claim 1, including guide rollers pivotally mounted on said casing, guide rods contacting said guide rolls and being guided thereby, blocks coupled to said driving members, wherein said guide rods are connected to said blocks and stop means fixed to said blocks for and contacting said driving hook levers for maintaining a predetermined range of attitude therefor.

* * * * *